US007081155B2

(12) United States Patent
Loreth

(10) Patent No.: US 7,081,155 B2
(45) Date of Patent: Jul. 25, 2006

(54) PARTICLE SEPARATOR

(75) Inventor: Andrzej Loreth, Akersberga (SE)

(73) Assignee: Eurus Air Design AB, Akersberga (SE)

( * ) Notice: Subject to any disclaimer, the term of this patent is extended or adjusted under 35 U.S.C. 154(b) by 198 days.

(21) Appl. No.: 10/486,325

(22) PCT Filed: Aug. 8, 2002

(86) PCT No.: PCT/SE02/01439

§ 371 (c)(1),
(2), (4) Date: Feb. 10, 2004

(87) PCT Pub. No.: WO03/013734

PCT Pub. Date: Feb. 20, 2003

(65) Prior Publication Data

US 2004/0182243 A1 Sep. 23, 2004

(30) Foreign Application Priority Data

Aug. 10, 2001 (SE) ..... 0102695
Nov. 5, 2001 (SE) ..... 0103684

(51) Int. Cl.
*B03C 3/08* (2006.01)

(52) U.S. Cl. ..... 96/69; 96/87; 96/98

(58) Field of Classification Search ..... 96/67, 96/69, 79, 86, 87, 98; 95/59, 78
See application file for complete search history.

(56) References Cited

U.S. PATENT DOCUMENTS 3,181,284 A * 5/1965 Copenhefer ..... 96/67
4,354,861 A 10/1982 Kalt ..... 96/69
4,673,416 A * 6/1987 Sakakibara et al. ..... 96/79
4,750,921 A * 6/1988 Sugita et al. ..... 96/67
5,582,632 A * 12/1996 Nohr et al. ..... 95/78
5,766,318 A * 6/1998 Loreth et al. ..... 96/69
5,980,614 A * 11/1999 Loreth et al. ..... 96/63
5,993,521 A * 11/1999 Loreth et al. ..... 96/69
6,090,189 A * 7/2000 Wikstrom et al. ..... 96/69
6,497,754 B1 * 12/2002 Joannou ..... 96/67
6,749,669 B1 * 6/2004 Griffiths et al. ..... 96/67
6,773,488 B1 * 8/2004 Potter ..... 95/59
2004/0226448 A1 * 11/2004 Griffiths et al. ..... 96/67

FOREIGN PATENT DOCUMENTS

WO WO 93/16807 9/1993
WO WO 95/14534 6/1995
WO WO 97/09117 * 3/1997
WO WO 97/46322 * 12/1997

* cited by examiner

*Primary Examiner*—Richard L. Chiesa
(74) *Attorney, Agent, or Firm*—Young & Thompson

(57) ABSTRACT

Particle separator having a flow passage for air to be cleaned from electrically charged particles includes at least two electrode element surfaces arranged substantially parallel to each other and at a mutual gap width (d), at least one electrode element surface being designed from a very high ohmic material, preferably with a resistivity corresponding to or higher than antistatic. The particle separator also is intended to be connected to a high voltage source, the second electrode element surface being intended to be connected to the pole of the high voltage source having the lowest absolute potential.

10 Claims, 9 Drawing Sheets

PRIOR ART

PARTICLE SEPARATOR

TECHNICAL FIELD OF THE INVENTION

This application is a national stage of International Application No. PCT/SE02/01439, filed on Aug. 8, 2002.

The present invention relates to a particle separator having a flow passage for the air to be cleaned, said particle separator being intended for cleaning air from electrically charged particles and comprises at least two electrode element surfaces arranged substantially parallel to each other and at a mutual gap width, at least one electrode element surface being designed from a very high ohmic material, preferably with a resistivity corresponding to or higher than antistatic, and that the particle separator also is intended to be connected to a high voltage source, said second electrode element surface being intended to be connected to the pole of the high voltage source having the lowest absolute potential.

PRIOR ART

In WO 93/16807 and SE WO 95/14534 a two step electro filter having a ionisation section is described, said electro filter on the downstream side being followed by a so called precipitator. The electrode elements of the precipitator, said elements in the mentioned patent applications constituting non-metallic material of very high resistivity (so called antistatic material), having a considerable improvement regarding separating capacity compared to precipitators of traditional design, i.e. of metallic material. These operating properties are based on the fact that electrode elements of material having antistatic resistivity may be connected to a higher mutual voltage, without the risk of a spark-over between adjacent electrode elemements compared to corresponding electrode elements that are designed from material having low resistivity.

In accordance with international patent application WO 93/16807 electric connection of respective electrode element is effected by having a current carrying paint arranged on the edge portions of the electrodes, said respective electrode element being located in such a way that a current carrying edge portion of one electrode element is positioned at a gap width from the other electrode element and alternately.

In accordance with international patent application WO 95/14534 the edge portions of the electrode elements in a precipitator are surrounded by an electrically insulating material in order to counteract corona current discharge from the edge portions and thus enable even higher voltage application of adjacent electrode elements in a precipitator of the type in question.

Working experiences of precipitators designed in accordance with the above-mentioned patent specifications have shown that said precipitators, despite the advantages mentioned above, have a relatively large difference as regards separation capacity for aerosols, due to the relative humidity of the air that passes through such precipitators.

In laboratory tests with precipitators designed from cellulose based material and located in environments with varying relative humidity it has surprisingly shown that at a high humidity the threshold value is dramatically decreased (i.e. the voltage at which corona current discharge starts) for corona current discharge between adjacent edge portions of respective electrode elements. This phenomena is probably due to that edge portions of cut cardboard constitute a lot of micro fibres that emit corona discharge like small pointed electrodes. The forceful dependency between the threshold value of the corona current discharge and the relative humidity of the air may depend from a highly varying resistivity in the fibres. This may be the case despite the fact that respective electrode elements are on one hand designed from cellulose material covered with thin plastic film in order to prevent a change in the resistivity of the material due to humidity (in accordance with the specification of WO 97/09117) and on the other hand that the electrode elements may be designed with electrically insulating structures that are provided over the edge portions of the electrode elements (in accordance with the specification of WO 95/14534) to prevent corona current discharge from these electrode elements. The last mentioned treatment is evidently not resulting in a sufficient inclusion (insulation) especially in connection with such embodiments where the gap width between adjacent electrode elements is not much differing from the thickness of the material from which respective electrode elements are designed and it is also in practice difficult to apply an electrically insulating structure with sufficient accuracy.

FURTHER BACKGROUND OF THE PRESENT INVENTION

FIG. 1*a* shows a known embodiment of a precipitator designed from cellulose material, said precipitator including two electrode elements 1, 2 arranged with a mutual gap width "d" and arranged in planes parallel to each other. As is evident from FIG. 1*b* the electrode elements 1, 2 are electrically connected to respective poles of a high voltage source HVU through galvanic connection to an electrically semi-conducting or current carrying wire drawing a, b attached to the edge portions k1, k2 of the respective electrode elements 1, 2.

The circumstances concerning voltage-current that is valid between the electrode elements 1, 2 are shown in FIG. 1*b*. One pole of the high voltage source HVU is electrically earthed and is connected to the current carrying edge portion k1 of one electrode element 1. The other alive pole (+) is connected to the current carrying edge portion k2 of the other electrode element 2 (wire drawing b). In this case the edge portion and the wire drawing coincide. The width of the electrode elements 1, 2, seen in the air flow direction through the precipitator, is equal to "B". The voltage across the gap between the adjacent edge portions k1-k2', k1'-k2 is designated Uk and corresponds to the voltage that maintains the corona discharge current Ic from the edge portions k2, k2'.

At the top of FIG. 1*c* a voltage diagram is drawn for the electrode element 2 as a function of the width "B" of the electrode element 2. The diagram over the electrode element 2 shows that there is a linear increase in voltage from the voltage level Uk, closest to the edge portion k2', to the corresponding U'=HVU(+) at the edge portion k2, i.e. the alive pole of the high voltage source having the highest potential.

The intermediate diagram in FIG. 1*c* shows the corresponding voltage diagram for the electrode element 1 where the voltage is equal to zero at the edge portion k1, said voltage increasing linearly to the voltage level U"=HVU (+)−Uk at the edge portion k1'.

By positioning both diagrams in one, at the bottom of FIG. 1*c*, the gap voltage Usp is given as a function of the width "B" of the electrode elements 1, 2.

For reasons of simplicity the corona current from the edge portions n'-m', m-n has been disregarded. For band like electrode elements having a length "L" that is several times the width this assumption is perfectly correct. For rectangular electrode elements the approximation is acceptable under the prerequisite that the width of the electrode elements is considerably larger than their extension in the direction of the air flow or that the edge portions n'-m', m-n are included, e.g. by use of electrically insulating material.

As FIG. 1*c* shows the gap voltage Usp between two electrode elements 1, 2 of very high ohmic material is essentially constant over the entire gap and the width "B" of the electrode elements, seen in the direction of the air flow, and equal to the voltage Uk that upholds the corona discharge current Ic.

If the diagram shown in FIG. 1*d* is considered, said diagram showing approximately the corona discharge current Ic as a function of the voltage Uk between edge portions of two adjacent electrode elements, it is realised that the steeper the curve is, i.e. the larger the derivative (Ic1-Ic2)/(Uk1-Uk2) is, the less the level of the gap voltage Usp is affected by increasing high voltage supply HVU. In other words the gap voltage Usp between two electrode elements designed of very high resistive, preferably antistatic, material (inside the voltage area above the treshold value for corona discharge between the edge portions of the electrodes) is only to a minor degree affected by increasing supply voltage (high voltage HVU) to those electrode elements.

By increasing air humidity (Rh—relative air humidity), i.e. Rh1>Rh2 a displacement towards lower voltage levels of the threshold voltage of edge corona discharge takes place, this being verified in the laboratory tests (see FIG. 1*e*). Simultaneously the derivative increases (Ic1-Ic2/Uk1-Uk2), i.e. the edge corona voltage as a function of the edge corona current increases towards a steeper progress. Thereby, a considerable decrease of the edge corona voltage Uk and hence a decrease of the gap voltage Usp takes place by increasing air humidity and at a constant edge corona current (Ic=constant). The ability of high resistive precipitators to separate particles decreases to the same extension. The understanding as outlined above constitutes the base of the present invention.

OBJECTS AND FEATURES OF THE INVENTION

The primary object of the present invention is to present a new highly resistive (antistatic) particle separator having essentially improved operative parameters than previously known embodiments.

Still an object of the present invention is to make the particle separator less sensitive to the relative humidity of the environment that the particle separator is located in.

At least the primary object of the present invention is realised by means of a particle separator that has been given the features of the appending independent claim. Preferred embodiments of the invention are defined in the dependent claims.

BRIEF DESCRIPTION OF THE DRAWINGS

Relevant prior art has been described above with reference to FIGS. 1*a*–1*e*, where.

Figure 2A:
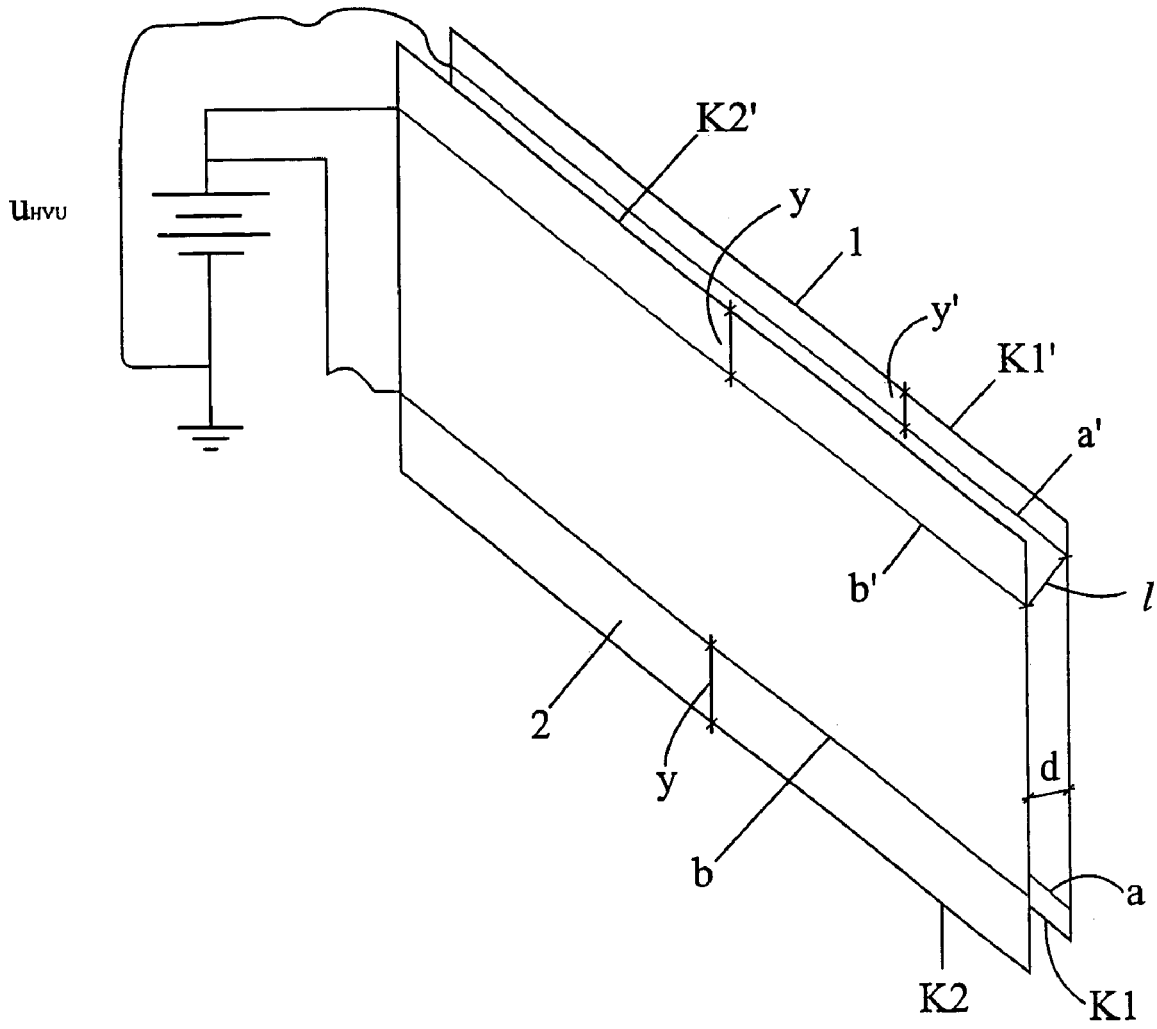
Figure 2B:
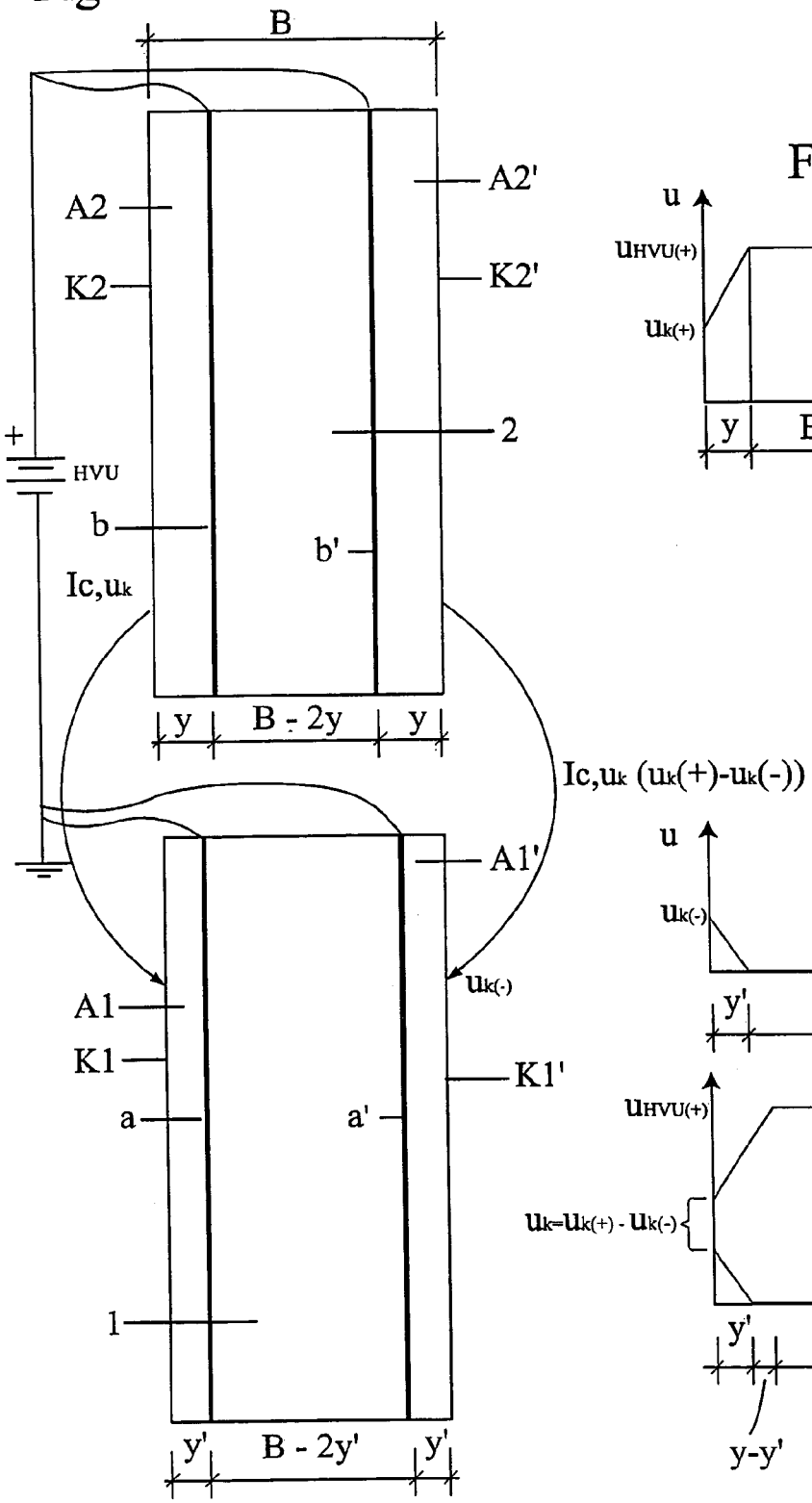

The present invention will be described more in detail in connection with the enclosed FIGS. 2*a*–5*b*, where:

FIG. 2*a* schematically shows a perspective view of a first embodiment of a particle separator;

FIG. 2*b* shows the electrode elements according to FIG. 2*a* spread in the plane of the paper and illustrate the relation voltage—current between two adjacent electrode elements 1, 2 in the embodiment of FIG. 2*a;*

Figure 2C:
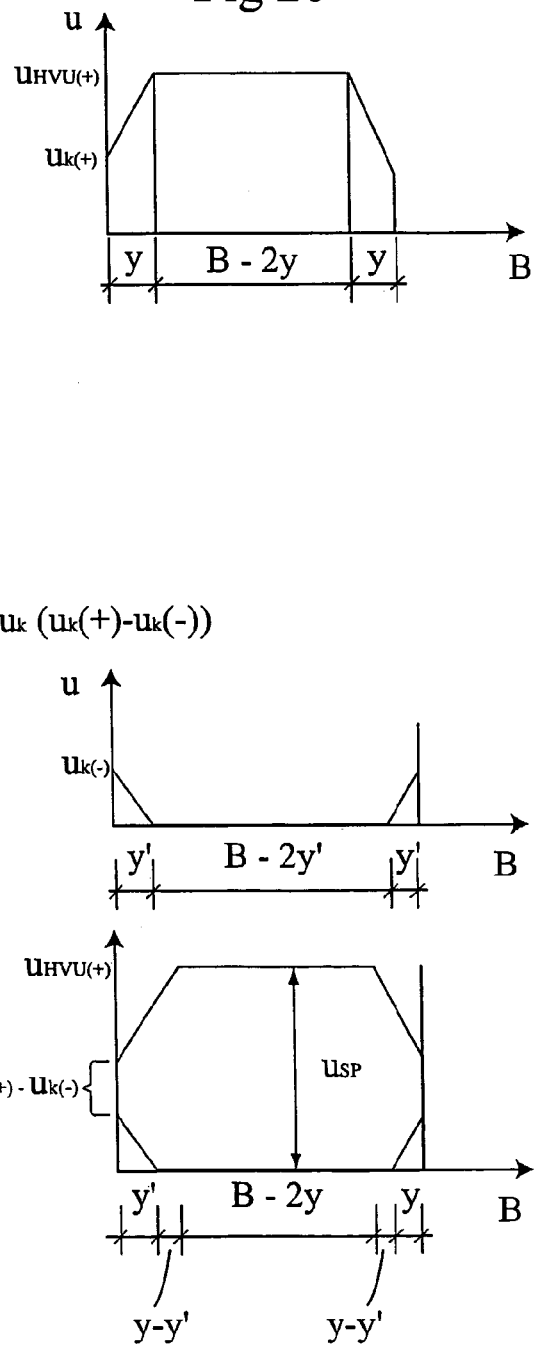
Figure 3A:
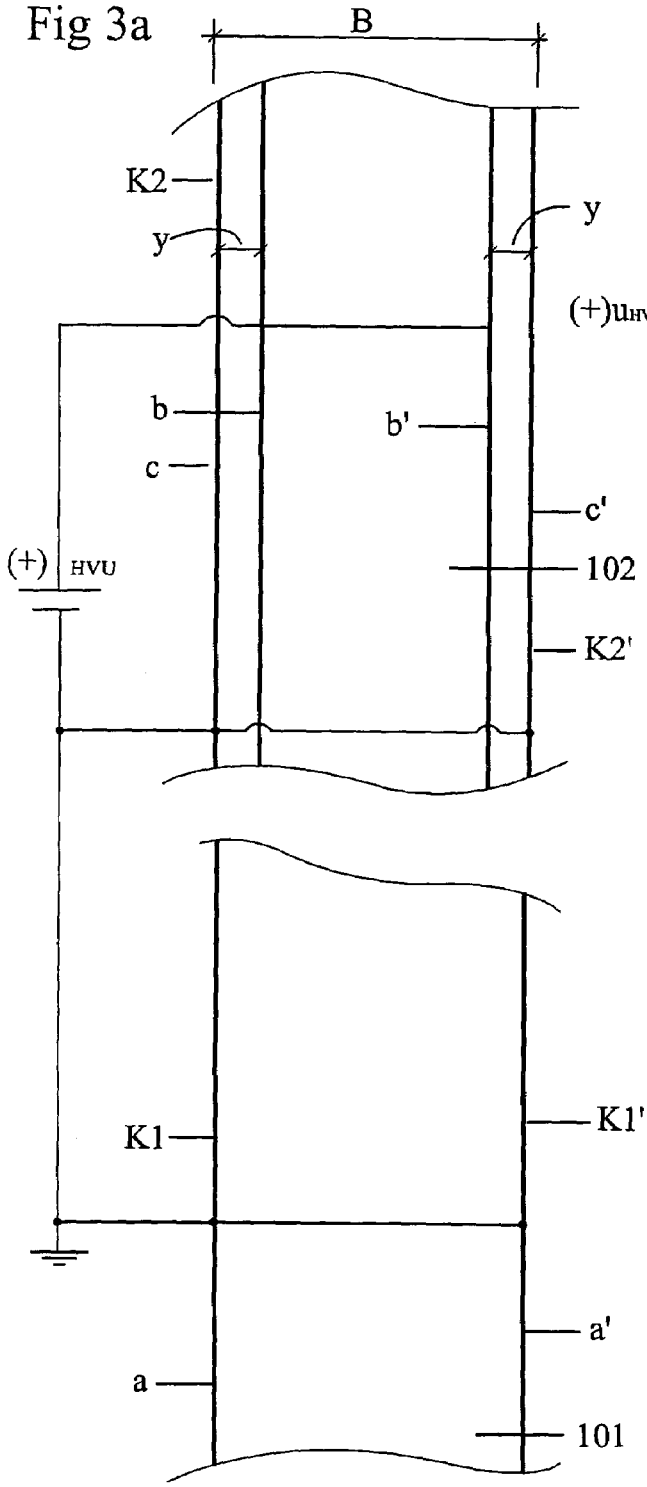
Figure 3B:
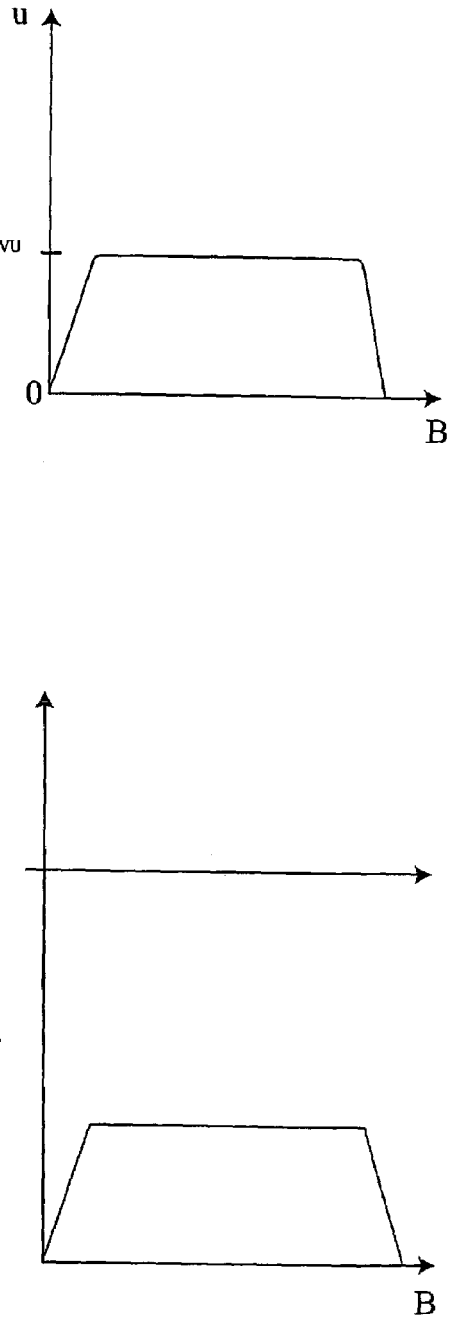

FIG. 2*c* shows three diagrams that relate to how the voltage varies across the width of an electrode element;

FIG. 3*a* shows a second embodiment of a particle separator according to the present invention;

FIG. 3*b* shows a number of voltage diagrams that relates to the embodiment according to FIG. 3*a;*

Figure 4A:
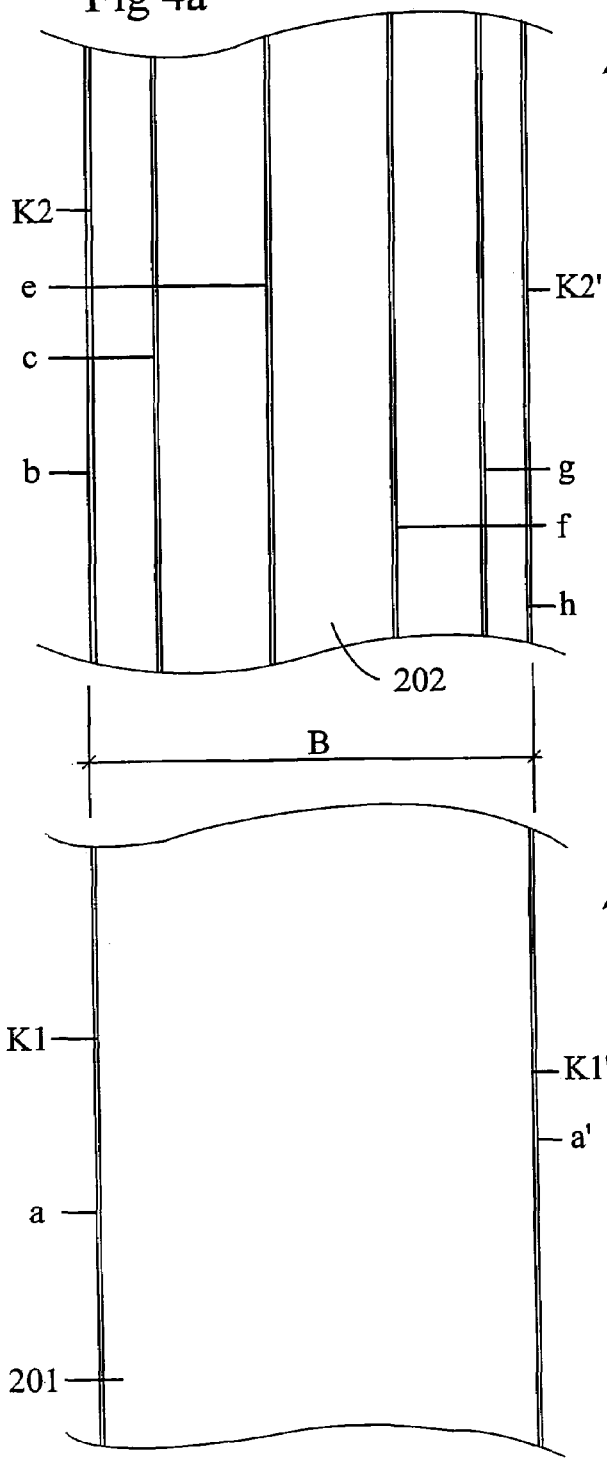
Figure 4B:
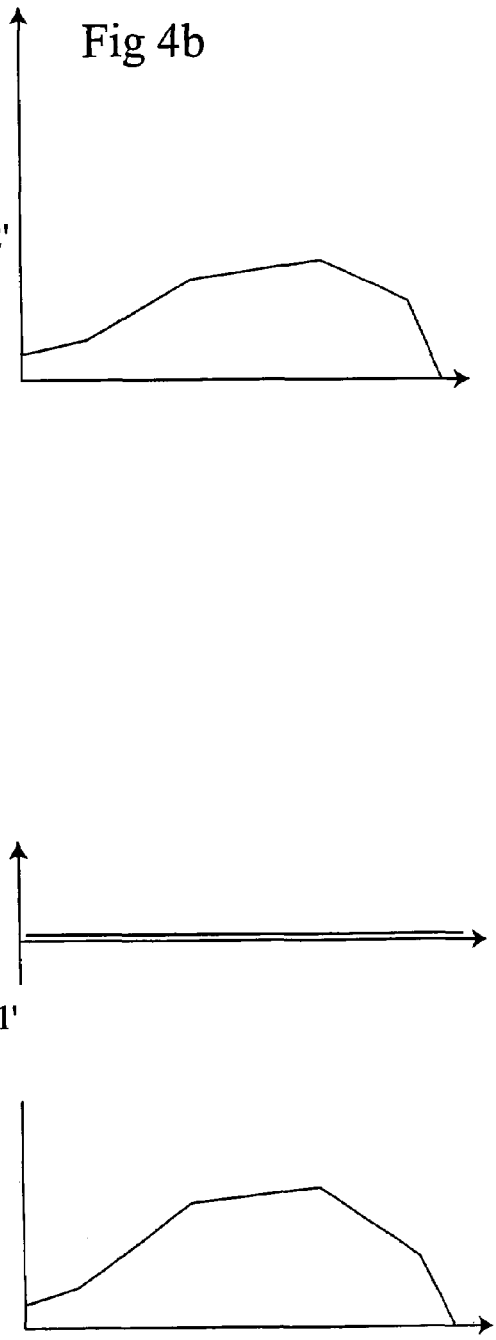

FIG. 4*a* shows a further embodiment of a particle separator according to the present invention;

FIG. 4*b* shows a number of voltage diagrams that are related to the embodiment according to FIG. 4*a;*

Figure 5A:
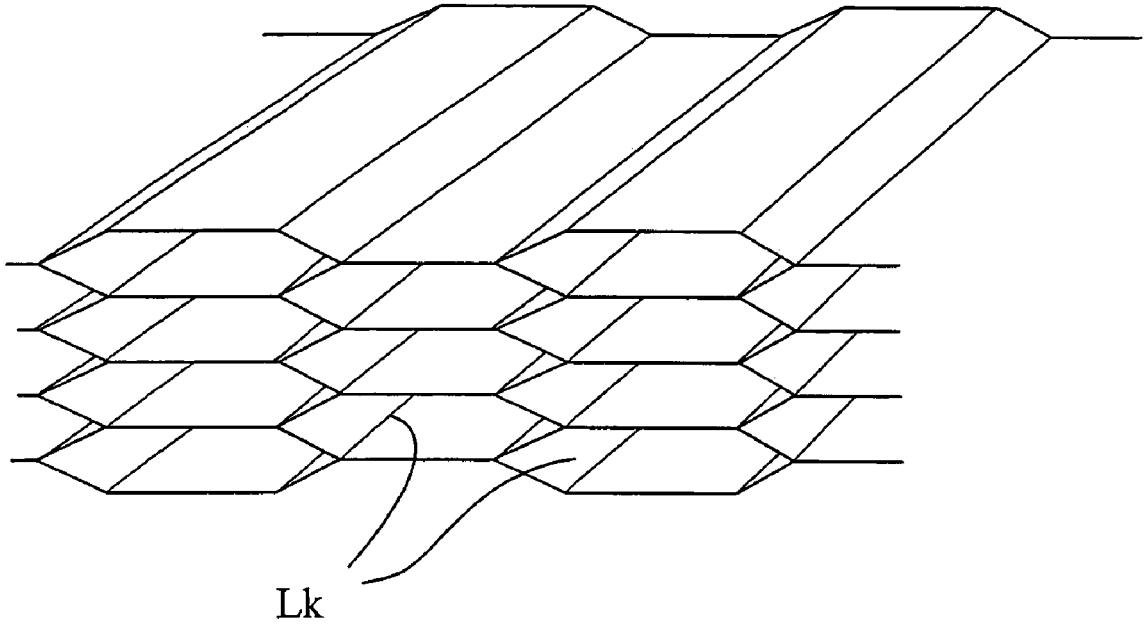
Figure 5B:
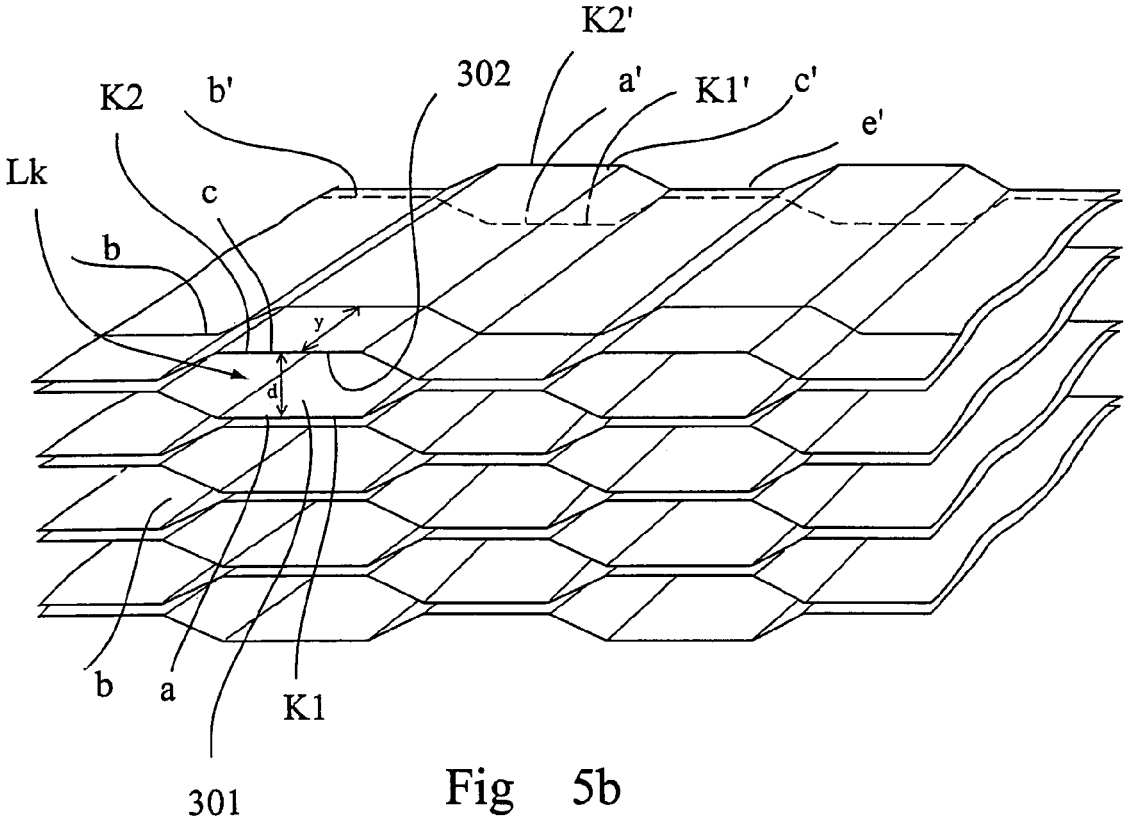

FIG. 5*a* shows a particle separator according to the present invention of "honeycomb" type; and FIG. 5*b* shows an arrangement of wire drawing for the particle separator according to FIG. 5*a.*

DETAILED DESCRIPTION OF PREFERRED EMBODIMENTS

FIG. 2*a* shows two highly resistive, from cellulose material designed, electrode element surfaces 1 and 2 arranged parallel to each other and at a mutual gap width "d". The electrode elements surfaces 1, 2 are planar and the air flow takes place in the gap between the electrode element surfaces 1, 2. Two thin lines in the shape of wire drawings a, a' and b, b' respectively of semi-conductive paint are provided by means of print, paint or corresponding treatment, the wire drawings a, a' being related to the electrode element surface 1 while the wire drawings b, b' are related to the electrode element surface 2. The wire drawing a is related to the edge portion k1 of the electrode elements surface 1 while the wire drawing a' is related to the edge portion k1' of the electrode element surface 1. In an analogue way the wire drawing b is related to the edge portion k2 of the electrode element surface 2 while the wire drawing b' is related to the edge portion k2' of the electrode elements surface 2. The wire drawings a, a' and b, b' respectively run parallel to each other and a certain distance from the edge portion k1, k1' and k2, k2' of respective electrode elements 1, 2. The wire drawings a, a' are connected to an electrically earthed pole of a high voltage source HVU and the wire drawings b, b' are connected to the other pole (+) of the high voltage source HVU.

In order to avoid spark-over between the wire drawings a, a', b, b' it is important that the wire drawings a, a' are not located opposite to the wire drawings b, b'. Thus the distance "1" in FIG. 2*a* should be at least equal to or larger than the double gap width "d".

Figure 1A:
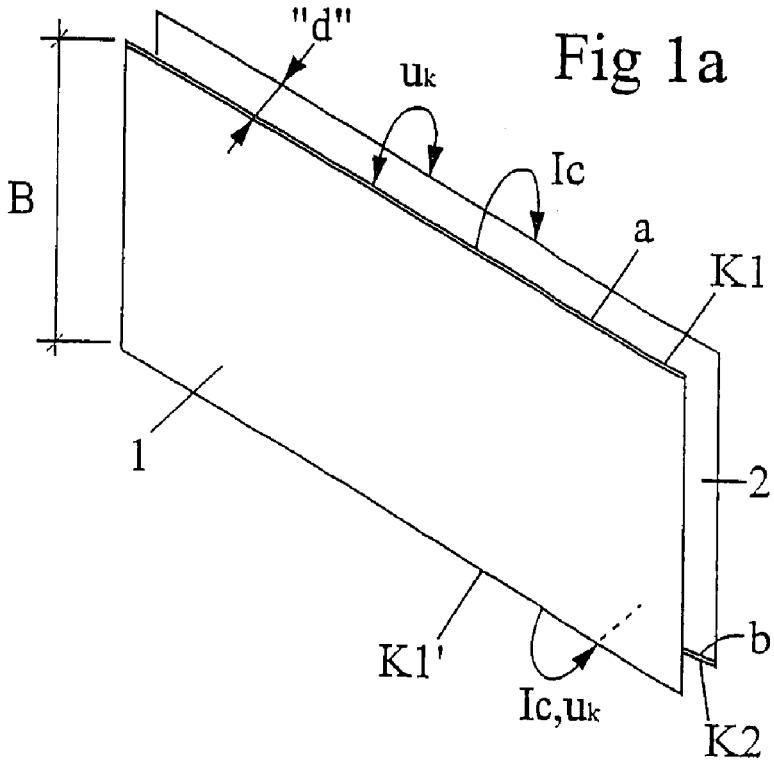
Fig 1a PRIOR ART
FIG. 1*a* shows a schematic perspective view of two electrode elements of a precipitator.
Figure 1B:
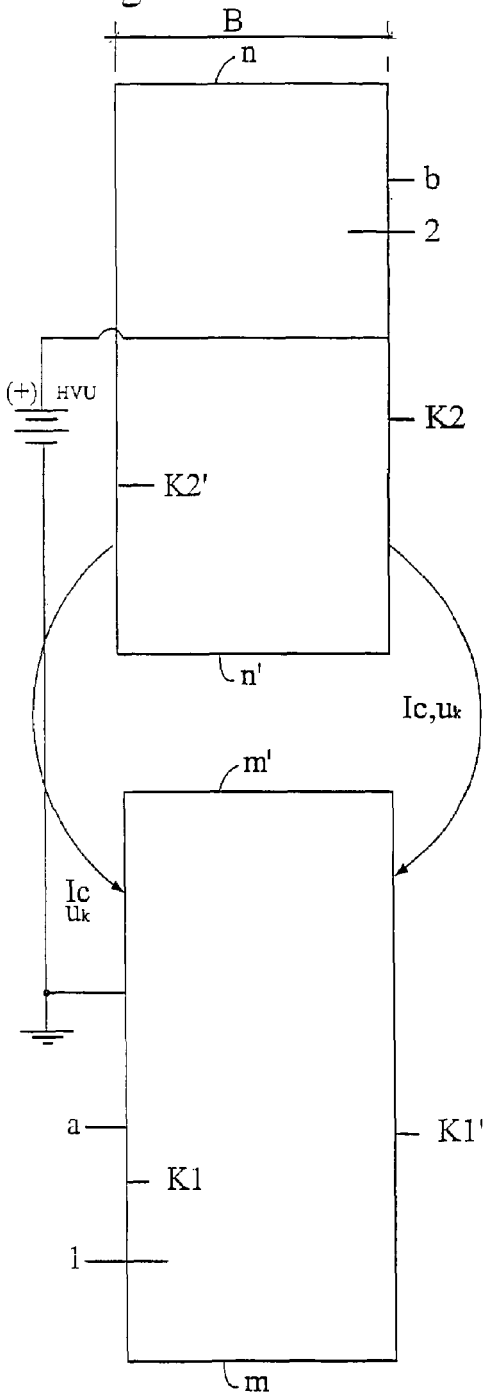
FIG. 1*b* shows the electrode elements according to FIG. 1*a* spread in the plane of the paper.
Figure 1C:
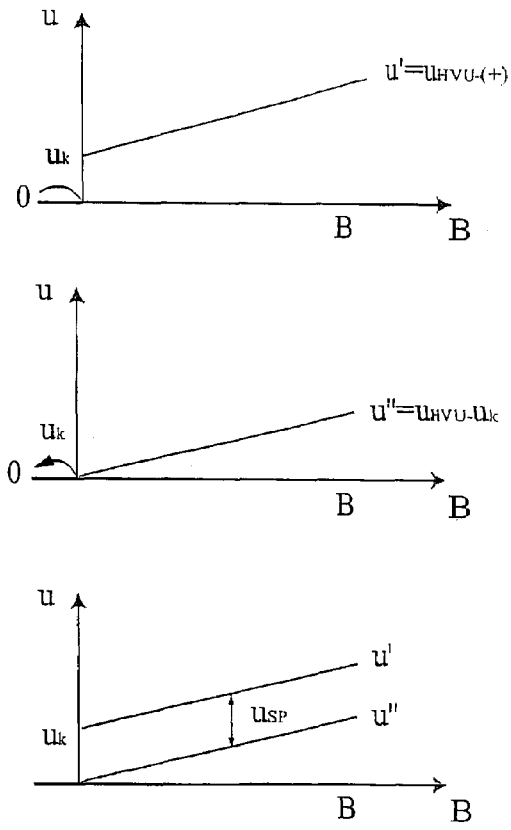
PRIOR ART Fig 1c
FIG. 1*c* shows three diagrams that relate to the variation of the voltage across the width of an electrode element.
Figure 1D:
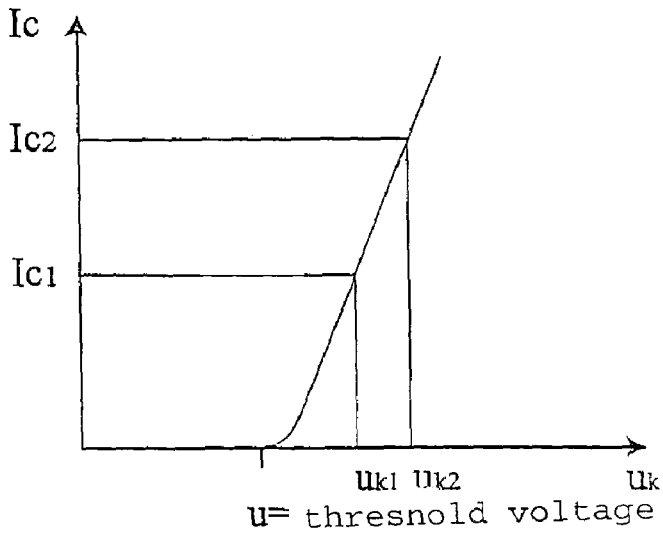
Fig 1d PRIOR ART
FIG. 1*d* shows the corona discharge current Ic as a function of the voltage Uk.
Figure 1E:
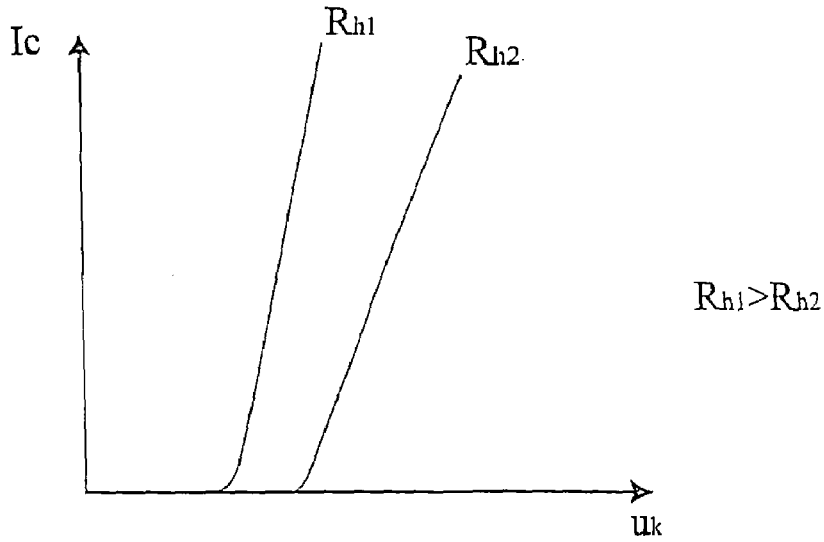
Fig 1e PRIOR ART
FIG. 1*e* shows the corona discharge current Ic as a function of the voltage Uk at varying relative humidity.

FIG. 2*b* shows the corresponding observation of the voltage conditions in the gap "d" between two adjacent electrode element surfaces 1, 2 corresponding to the observation shown in FIG. 1*b*. In FIG. 2*c* a voltage diagram is shown for respective electrode element surfaces 1, 2 as a function of the width "B" of respective electrode elements 1, 2. The voltage diagram at the top in FIG. 2*c* for the electrode element surface 2 shows a linear increase in voltage from the voltage level Uk at the edge portion k2 of the electrode element surfaces to the voltage U=HVU (+) at the level of the wire drawing string b. Within the area B-2*y*' the voltage is constant and equal to UHV(+). From the right end of the area B-2*y* in the voltage diagram the voltage decreases linearly to a value equal to Uk(+) at the edge portion k2' of the electrodes element surface.

The intermediate voltage diagram in FIG. 2*c* shows the corresponding voltage diagrams for the electrode element surface 1, said voltage being equal to zero in the area B-2*y*' and increasing voltage towards the edge portions k1, k1' on the electrode element surface 1, said voltage level corresponding to Uk(−). By placing both diagrams in a common diagram, at the bottom in FIG. 2*c*, the gap voltage Usp is given as function of "B", see FIG. 2*c*.

The wire drawings a, a', b, b' are preferably arranged in such a way that adjacent wire drawing strings on adjacent electrode elements 1, 2, e.g. a' and b', are arranged to be located at a larger distance from each other than twice the gap width "d" in order to avoid the spark-over risk between wire drawing strings that are connected to different poles of the high voltage source HVU.

As is shown by the diagram at the bottom of FIG. 2*c* the gap voltage Usp, in the portions of the gap that simultaneously is within area B-2*y* and B-2*y*', is equal to the voltage of the high voltage source HVU and fairly independent of the conditions regarding corona discharge from the edge portions k1, k1', k2, k2' of the electrode element surfaces 1, 2.

The design of the electrode element surfaces 1, 2 in accordance with the embodiment shown in FIG. 2 is however not preventing corona discharge (edge corona current Ic) between adjacent edge portions k1, k1', k2, k2' of the electrode elements 1, 2. Such a discharge produces on one hand unwanted generation of ozone and influence on the other hand particle shaped pollutions that are charged in the ionisation chamber, when said particles, together with the air flow, bypass the edge portions of the electrode elements 1, 2 and in through the particle separator. Under influence of the edge corona current Ic some of these particles loose their charge and may then freely pass the particle separator.

In accordance with the present invention it is possible to totally eliminate corona discharge current Ic between edge portions of adjacent electrode elements 1, 2 and also to control the gap voltage Usp in a desired way by suitably arranged wire drawing strings.

FIG. 3*a* shows an embodiment that constitutes a further development of the present invention. In the embodiment shown in FIG. 3*a* the wire drawing strings a, a' are arranged on, or in the absolute adjacency of, the edge portions k1, k1' of the electrode element surface 101 and wire drawing strings c, c' on the edge portions k2, k2' of the electrode element surface 102. Further, two wire drawing strings b, b' are arranged on the electrode element surface 102, said wire drawing strings running parallel to the edge portions k2, k2' and at a distance "y" from the edge portions k2, k2'. In accordance with the embodiment shown in FIG. 3*a* the wire drawing strings a, a', b, b' arranged on the edge portions k1, k1', k2, k2' are connected to the same pole of the high voltage source HVU and preferably earthed. The wire drawing strings b, b' are connected to the other pole of the high voltage source HVU(+). FIG. 3*b* shows voltage diagrams corresponding to the diagrams previously shown in FIG. 2*b*. The voltage diagram at the top of FIG. 3*b* shows the voltage over the electrode element surface 102, said gap voltage Usp according to the diagram being equal to zero at the edge portion k2 and then it increases linearly to the supply level HVU(+) of the high voltage source on the wire drawing string b. Between the wire drawing strings b, b' the voltage is constant and equal to the supply voltage from the high voltage source UHVU(+). From the wire drawing string b' the voltage decreases linearly down to zero at the edge portion k2'. The intermediate voltage diagram in FIG. 3*b* shows the voltage over the electrode element surface 101, said voltage constantly being equal to zero since both edge portions k1 and k1' of the electrode element surface 101 are connected to earth of the high voltage source UHVU(+). The diagram at the bottom of FIG. 3*b* shows an addition of the diagrams of the electrode element surfaces 101 and 102, said diagram being identical to the diagram at the top since the intermediate diagram has no influence. Thus, the voltage is zero at the inlet of the particle separator, said voltage increasing linearly to the supply voltage level UHVU(+) and then decreases linearly to zero at the outlet from the particle separator. Of course, it is not necessary to electrically connect all wire drawings a, a', b, b' to the same voltage pole of the high voltage source HVU. In practical embodiments it may however be an advantage.

In FIG. 4*a* further embodiment of the present invention is shown. The lower electrode element surface 201 in FIG. 4*a* corresponds in principle to the electrode element surface 101 in FIG. 3*a*, i.e. the edge portions k1, k1' are equipped with wire drawings a, a' that preferably are connected to earth of a high voltage source (not shown). The upper electrode element surface 202 in FIG. 4*a* is equipped with a number of wire drawings b, c, e, f, g, h that are arranged along the width B of the electrode element surface 202. As is evident from the upper voltage diagram in FIG. 4*b*, said diagram referring to the electrode element surface 202, the wire drawings are connected to different potential of the high voltage source. The reason therefore is to achieve an increasing voltage the greater the distance in between the electrode element surfaces that the charged particles in the air reach. It has been assumed that the air flow is directed to the right in FIG. 4*a*. At the right edge portion k2' of the electrode element surface 202 the voltage is substantially zero in order to avoid corona discharge from the edge portion k2'. The intermediate voltage diagram in FIG. 4*b* represents the electrode element surface 201 and the in the voltage diagram at the bottom of FIG. 4*b* the both above positioned diagrams have been added.

As is shown in FIG. 5*a* a so-called "honeycomb"-structure of preferably cellulose-based material is provided. Such a structure usually consists of several pleated paper strips that for instance are joined by a suitable adhesion in such a way that air flow channels "Lk" are created.

In the embodiment shown in FIG. 5*b* the particle separator of honeycomb type thus comprises a number of air flow channels "Lk", in which two opposite parallel electrode element surfaces 301 and 302 are incorporated. The electrode element surface 301 is rectangular or square and provided on a pleated carrier, said surface being equipped with wire drawing strings a, a' on the edge portions k1, k1' of the electrode element surfaces 301. The electrode element surface 302 is likewise the electrode element surface 301 pleated from a rectangular or a square surface and is on one hand provided with wire drawing strings c, c' on the edge portions k2, k2' of the electrode element surfaces 302 and on the other hand provided with wire drawing strings b, b' that are arranged at a distance "y" from the edge portions k2, k2' of the electrode element surfaces 302.

As is shown in FIG. 5*b* the particle separator of the honeycomb type according to the present invention is created from a number of pleated strips that assembled define several pairs of electrode element surfaces 301 and 302 respectively, said strips being arranged in the following turns: The electrode element surface 302 is followed by three electrode element surfaces 301 and then again an electrode element surface 302, whereupon follows three electrode element surfaces 301 and so on.

In accordance with the embodiment described in FIG. 5*b* the edge portions k1, k1', k2, k2', i.e. the wire drawing strings a, a', c, c', are connected to an earthed pole of the high voltage source HVU. The wire drawing strings b, b' are connected to the other pole of the high voltage source HVU.

A particle separator of "honeycomb"-type may be folded and is easy to design mechanically stable. The advantage of this embodiment is also the possibility to design large rectangular surfaces that are permeable to air flow.

It is easy to realise that by choosing the number of wire drawing strings, their location and the voltage application of these wire drawing strings high resistive particle separators according to the present invention may be custom made for desired operation conditions.

Indeed the particle separator according to the present invention brings about a certain load on the high voltage source due to the resistive current that is fed through the very high-resistive material of the electrode element surfaces 1, 2; 101, 102; 201, 202; 301, 302 in the area of the edge portions of the electrode element surfaces 1, 2; 101, 102; 201, 202; 301, 302. For this reason the expression "particle separator" has been used in the present patent application since the device does not constitute a precipitator in traditional meaning. By the use of very high ohmic, preferably antistatic, material as for instance cellulose based material it is still a question of negligible required power, especially when particle separators are designed with very small gap width "d" between respective electrode element surfaces 1, 2; 101, 102; 201, 202; 301, 302.

The present invention is not restricted to any special embodiments of wire drawing strings a, a', b, b', c, c', e, e', f, f'. The most important is that through these strings or current carrying or semi-conductive means that are arranged on the electrode element surface 1, 2; 101, 102; 201, 202; 301, 302 it is achieved that preferably a substantial portion or substantial portions of a respective electrode element surface 1, 2; 101, 102; 201, 202; 301, 302 may be energised in a controlled way as well as a defined potential of the edge portions k1, k1', k2, k2' of the electrode element surface.

It is a common feature for all the above described embodiments that the distance "y" between the current carrying or semi-conductive means and the edge portions k1, k1', k2, k2' of the electrode element surfaces 1, 2; 101, 102; 201, 202; 301, 302 is at least equal to twice the gap width "d".

It may be an advantage that several wire drawing strings and/or wire drawing patterns are arranged on one and the same electrode element surface 1, 2; 101, 102; 201, 202; 301, 302. In certain cases it may be an advantage that these wire drawing strings and/or wire drawing patterns may be connected to separate poles of the high voltage source or to separate high voltage sources. In such a case it might be an advantage that the wire drawing string that is furthest away from the edge portion k1, k1', k2, k2' of respective electrode element surfaces is connected to a higher voltage than other wire drawing string that is closer to the edge portion k1, k1', k2, k2' of the electrode element surfaces.

A forced energising over portions of the gap "d" is a prerequisite for constant separating ability of high-resistive (antistatic) particle separators.

It is thus of no importance how the charging is effected of aerosols in the air that is transported through the device or which voltage polarity the high voltage source HVU has. It is neither of any importance how the air transport through the device is taken care of. The transport may be effected by means of mechanical fans, electric wind fans, draught or in other known ways. Preferably, cellulose based material may be used for the electrode element surfaces of the particle separator. Wire drawing strings (pattern) are suitably attached to the material and then the material is preferably coated with a thin damp-proof membrane of a plastic, e.g. polyethylene. Such treatment of a paper is known and is used for instance in connection with food packages.

The present invention may preferably be used to design particle separators of planar, parallel electrode element surfaces that are arranged at a mutual gap width of "d" or particle separators of band-like electrode element surfaces several times wound round an axis at a gap width "d" in accordance with the specification of the international patent application WO 97/46322. It is also possible to design quiet different shapes of particle separators in accordance with FIGS. 5*a* and 5*b*.

It should be pointed out that the particle separator according to the present invention does not comprise a high voltage source HVU since it in practice very well may be that the user already has a high voltage source (HVU), to which the particle separator could be connected.

FEASIBLE MODIFICATIONS OF THE INVENTION

In connection with the embodiments described above all electrode element surfaces have a high resistivity. However, within the scope of the present invention it is also feasible that one electrode element surface is metallic and in such a case it is suitable to connect this surface to earth.

In the embodiments described above the electrode element surfaces have two current carrying or semi-conductive means that are arranged at a certain distance from the edge portions of the electrode element surfaces. However, within the scope of the present invention it is also feasible that one electrode element surface has only one current carrying or semi-conductive means that in such a case preferably is arranged at the same distance from the edge portions of the electrode element surfaces.

In connection with the embodiments described above according to FIGS. 2*a* and 3*a* the positive pole of the high voltage source HVU has the highest potential. However, this potential may on the contrary be negative while the other pole for instance is earthed. For this reason the expression "absolute potential" has been used in the claims.

The invention claimed is:

1. Particle separator having a flow passage for the air to be cleaned, said particle separator being intended for cleaning air from electrically charged particles and comprises at least two electrode element surfaces (1, 2; 101, 102; 201, 202; 301, 302) arranged substantially parallel to each other and at a mutual gap width (d), at least one electrode element surface (2; 102; 202; 302) comprising a very high ohmic material, optionally with a resistivity corresponding to or higher than antistatic, and that the particle separator also is intended to be connected to a high voltage source (HVU), said second electrode element surface (1; 101; 201; 301) being intended to be connected to the pole of the high voltage source (HVU) having the lowest absolute potential, wherein, the electrode element surface (2; 102; 202; 302) made from high ohmic material is equipped with at least one current carrying or semi-conductive means (b, b') arranged at a distance from the edge portions (k1, k1', k2, k2') of the electrode element surface (2, 102;

202; 302), and the current carrying or semi-conductive means (b, b') is intended to have a galvanic connection to the pole of the high voltage source (HVU) having the highest absolute potential.

2. Particle separator according to claim 1, wherein, both of the electrode element surfaces (1, 2; 101, 102; 201, 202; 301, 302) are designed from a very high ohmic material, optionally with a resistivity corresponding to or higher than antistatic, both electrode element surfaces (1, 2; 101, 102; 201, 202; 301, 302) each are equipped with at least one current carrying or semi-conductive means (a, a', b, b') arranged at a distance from the edge portions (k1, k1', k2, k2') of the electrode element surfaces (1, 2; 101, 102; 201, 202; 301, 302).

3. Particle separator according to claim 1, wherein, both electrode element surfaces (1, 2; 101, 102; 201, 202; 301, 302) from comprising a very high ohmic material, optionally with a resistivity corresponding to or higher than antistatic, the edge portions (k1, k1', k2, k2') of both electrode element surfaces (1, 2; 101, 102; 201, 202; 301, 302) each are equipped with current carrying or semiconductive means (a, a', c, c') that are intended to be connected to the lowest absolute potential of the high voltage source (HVU), and one electrode element surface (2; 102; 202; 302) is equipped with at least one further current carrying or semiconductive means (b, b') arranged at a distance from the edge portions (k1, k1', k2, k2') of the electrode element surface (2; 102; 202; 302), and the current carrying or semiconductive means (b, b') is arranged to have a galvanic connection to the pole of the high voltage source (HVU) having the highest potential.

4. Particle separator according to claim 1, wherein, the current carrying or semi-conductive means (a, a', b, b', c, c', e, e', . . .) are attached to the electrode element surfaces (1, 2; 101, 102; 201, 202; 301, 302) by means of print, paint, or etching.

5. Particle separator according to claim 1, wherein, the current carrying or semi-conductive means for each electrode element surface (1, 2; 101, 102; 201, 202; 301, 302) constitutes at least two strings (a, a', b, b', c, c', e, e', . . .) that are essentially parallel to each other and to the edge portions (k1, k1', k2, k2').

6. Particle separator according to claim 1, wherein, the surface that is covered by the current carrying or semiconductive means (a, a', b, b', c, c', e, e', . . .)constitutes a fraction of the respective electrode element surface (1, 2; 101, 102; 201, 202; 301, 302).

7. Particle separator according to claim 1, wherein, the current carrying or semi-conductive means (a, a', b, b', c, c', e, e', . . .) have an extension perpendicular to the air flow direction through the particle separator.

8. Particle separator according to claim 1, wherein, the electrode elements are provided on bands several times wound around an imaginary axis.

9. Particle separator according to claim 1, wherein the electrode element surfaces (1, 2; 101, 102; 201, 202; 301, 302) are designed from cellulose material.

10. Particle separator according to claim 1, wherein the electrode element surfaces (1, 2; 101, 102; 201, 202; 301, 302) are coated with a thin damp proof layer.

* * * * *